US008522503B1

(12) United States Patent
Egan, Jr. et al.

(10) Patent No.: US 8,522,503 B1
(45) Date of Patent: Sep. 3, 2013

(54) PRECAST SURROUND ASSEMBLY FOR A UTILITY POLE FOUNDATION

(75) Inventors: Thomas L. Egan, Jr., Omaha, NE (US); Michael Baldino, Jr., Omaha, NE (US)

(73) Assignee: Enterprises Properties, Inc., Omaha, NE (US)

( * ) Notice: Subject to any disclaimer, the term of this patent is extended or adjusted under 35 U.S.C. 154(b) by 113 days.

(21) Appl. No.: 12/907,483

(22) Filed: Oct. 19, 2010

Related U.S. Application Data

(60) Provisional application No. 61/252,824, filed on Oct. 19, 2009.

(51) Int. Cl.
*E04H 12/22* (2006.01)

(52) U.S. Cl.
USPC ..... 52/704; 52/292; 52/296; 52/298; 52/294; 52/708; 52/706

(58) Field of Classification Search
USPC ..... 52/292, 293.1, 169.1, 169.9, 167.7, 52/167.8, 167.9, 294–298, 742.1, 704, 706, 52/708
See application file for complete search history.

(56) References Cited

U.S. PATENT DOCUMENTS 715,362 A * 12/1902 May ..... 52/835
1,647,925 A * 11/1927 May ..... 52/223.5
1,837,145 A * 12/1931 Brooks ..... 52/444
2,994,162 A * 8/1961 Frantz ..... 52/592.5
3,653,168 A * 4/1972 Cook ..... 52/294
4,785,593 A * 11/1988 Munoz, Jr. ..... 52/126.1
5,143,472 A * 9/1992 Reed et al. ..... 403/230
6,176,055 B1 * 1/2001 Fu ..... 52/292

FOREIGN PATENT DOCUMENTS

EP 170230 A * 2/1986

* cited by examiner

*Primary Examiner* — Jeanette E. Chapman
(74) *Attorney, Agent, or Firm* — Suiter Swantz pc llo

(57) ABSTRACT

The present disclosure is directed to a precast collar for providing a protective structure (ex.—a surround structure), a proprietary support structure and an appearance-enhancing (ex.—non-distracting) base accessory for a pole foundation and a pole (ex.—for a utility pole foundation and utility pole). The precast collar may be formed of precast concrete and may be of sufficient dimensions and construction for at least substantially surrounding and for protecting a support structure and body structure portion of a pole foundation. The precast collar may form a recessed portion for receiving a support structure of a pole foundation. The precast collar may be supported upon the pole foundation via the support structure of the pole foundation, while providing access to a base structure of the pole foundation via a cavity formed through the collar, so that said base structure may be connected to a pole.

6 Claims, 9 Drawing Sheets

PRECAST SURROUND ASSEMBLY FOR A UTILITY POLE FOUNDATION

CROSS-REFERENCE TO RELATED APPLICATIONS

The present application claims priority under 35 U.S.C. §119(e) to U.S. Provisional Application No. 61/252,824 entitled: Precast Surround Assembly for a Utility Pole Foundation filed Oct. 19, 2009, which is hereby incorporated by reference in its entirety.

FIELD OF THE INVENTION

The present invention generally relates to the field of pole foundation accessories, and more particularly to a precast surround assembly for use with a pole foundation (ex.—a utility pole foundation).

BACKGROUND OF THE INVENTION

A number of surround assemblies for utility pole foundations may be inconvenient and/or impractical to implement.

Accordingly, it would be desirable to provide a surround assembly for a utility pole/light pole which addresses the above-referenced shortcomings of current surround assemblies.

SUMMARY OF THE INVENTION

Accordingly an embodiment of the present disclosure is directed to a collar, including: a perimeter wall; a first end wall, the first end wall being connected to the perimeter wall; a second end wall, the second end wall being connected to the perimeter wall, the first end wall and the second end wall forming opposite ends of the collar, said first end wall and said second end wall being spaced apart from each other by the perimeter wall, the second end wall including at least one recessed portion, the at least one recessed portion configured for receiving a support structure of a pole foundation for allowing the collar to be supported upon the support structure via engagement of the support structure against the second end wall, wherein the collar forms a longitudinally-extending cavity, said cavity being formed through the collar and extending from the first end wall to the second end wall, said cavity configured for receiving a base structure and a body structure of the pole foundation.

A further embodiment of the present disclosure is directed to a bumper precast surround assembly, including: a first collar, the first collar including: a perimeter wall; a first end wall, the first end wall being connected to the perimeter wall; and a second end wall, the second end wall being connected to the perimeter wall, the first end wall and the second end wall forming opposite ends of the first collar, said first end wall and said second end wall being spaced apart from each other by the perimeter wall, the first collar forming a longitudinally-extending cavity, said cavity being formed through the first collar and extending from the first end wall to the second end wall, the second end wall forming at least one recessed portion, the at least one recessed portion configured for receiving a support structure of a pole foundation for allowing the bumper precast surround assembly to be supported upon the support structure via engagement of the support structure against the second end wall of the first collar; and a second collar, the second collar configured for being stacked upon the first collar, the second collar including: a perimeter wall; a first end wall, the first end wall of the second collar being connected to the perimeter wall of the second collar; and a second end wall, the second end wall of the second collar being connected to the perimeter wall of the second collar, the first end wall and the second end wall of the second collar forming opposite ends of the second collar, said first end wall of the second collar and said second end wall of the second collar being spaced apart from each other by the perimeter wall of the second collar, the second collar forming a longitudinally-extending cavity, said cavity being formed through the second collar and extending from the first end wall of the second collar to the second end wall of the second collar, the second end wall of the second collar being supported upon and oriented towards the first end wall of the first collar when the second collar is stacked upon the first collar to form the bumper precast surround assembly, wherein the cavity of the first collar and the cavity of the second collar are configured for being aligned when the collars are stacked, thereby forming an aggregate cavity extending longitudinally through the collar stack, said aggregate cavity configured for receiving a base structure and a body structure of the pole foundation.

A still further embodiment of the present disclosure is directed to a precast surround collar for a pole foundation, the precast surround collar including: a perimeter wall; a first end wall, the first end wall being connected to the perimeter wall; and a second end wall, the second end wall being connected to the perimeter wall, the first end wall and the second end wall forming opposite ends of the collar, said first end wall and said second end wall being spaced apart from each other by the perimeter wall, the second end wall including at least one recessed portion, the at least one recessed portion configured for receiving a support structure of the pole foundation for allowing the collar to be supported upon the support structure via engagement of the support structure against the second end wall, wherein the collar forms a longitudinally-extending cavity, said cavity being formed through the collar and extending from the first end wall to the second end wall, said cavity configured for receiving a base structure and a body structure of the pole foundation, the collar being configured for at least substantially surrounding a portion of the body structure, and the support structure of the pole foundation when: said support structure is received within said recessed portion, the portion of the body structure is located within the cavity, and the second end wall of the collar is seated upon the support structure, for promoting protection of said support structure and said portion of the body structure, the collar further being configured such that the base structure of said pole foundation is accessible for being connected to a pole when: said support structure is received within said recessed portion, the portion of the body structure is located within the cavity, and the second end wall of the collar is seated upon the support structure, wherein the first end wall is oriented toward the pole and the second end wall is oriented away from the pole.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DESCRIPTION OF THE INVENTION

A number of surround assemblies (sometimes referred to as: bumpers/bumper assemblies/mower pads) for pole foundations (ex.—utility pole foundations) may be inconvenient/impractical to implement, especially if said assemblies include site casting concrete.

Accordingly, it would be desirable to provide a surround assembly for a pole/utility pole/light pole which addresses the above-referenced shortcomings of current surround assemblies.

Reference will now be made in detail to exemplary embodiments of the present disclosure, examples of which are illustrated in the accompanying drawings.

Figure 1A:
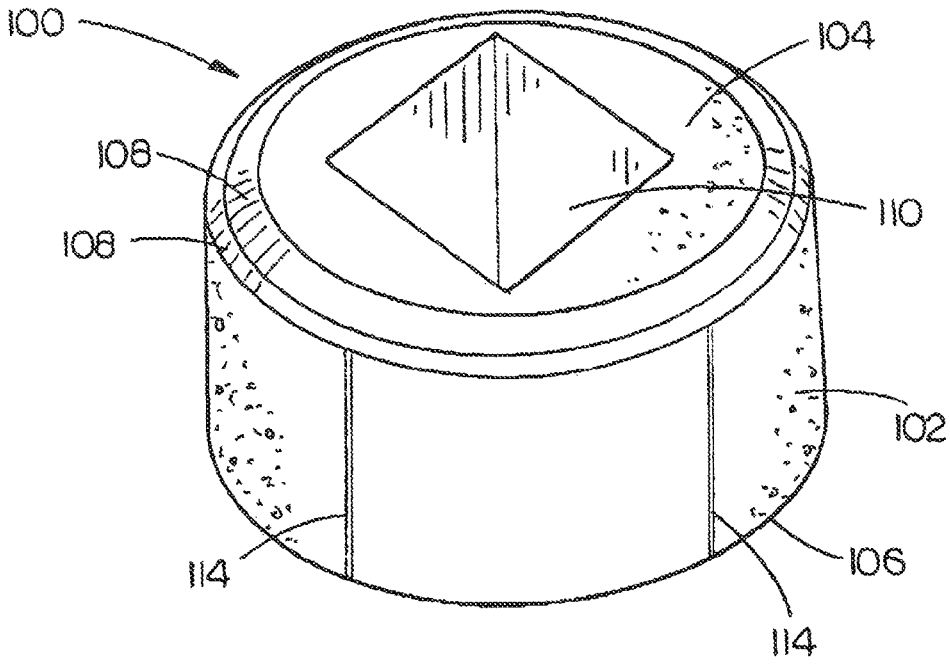
FIG. 1A is an isometric view of a precast surround collar from above the precast surround collar in accordance with an exemplary embodiment of the present disclosure.
Figure 1B:
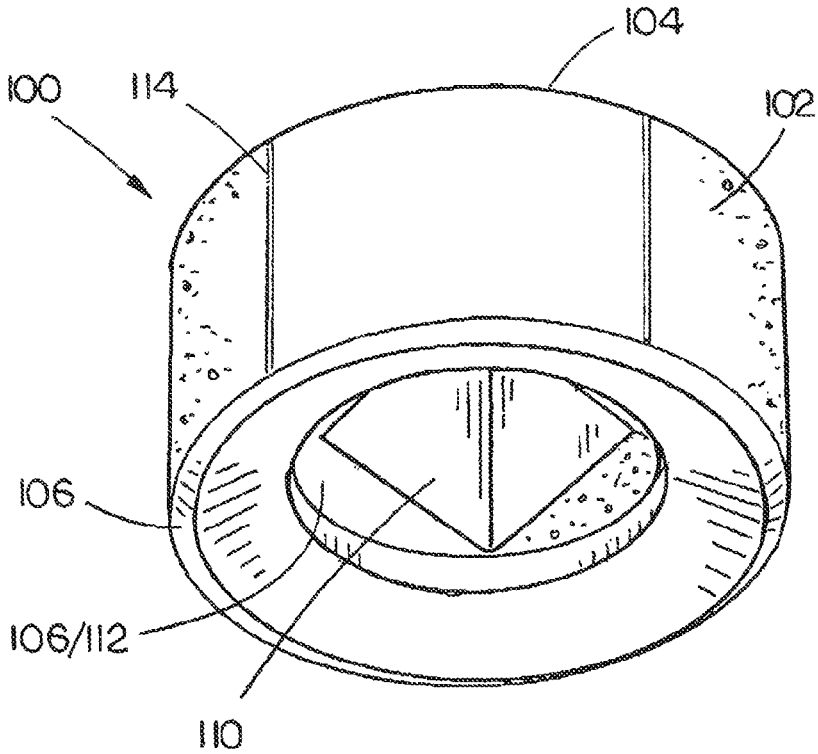
FIG. 1B is an isometric view of a precast surround collar from below the precast surround collar in accordance with an exemplary embodiment of the present disclosure.

Referring to FIGS. 1A and 1B, a collar in accordance with an exemplary embodiment of the present disclosure is shown. In exemplary embodiments of the present disclosure, the collar 100 may be configured as a longitudinally-extended (ex.—vertically-extended) body portion or longitudinally-extended cross-section. For example, the collar 100 may be a longitudinally-extended, generally cylindrically-shaped cross-section, as shown in FIGS. 1A and 1B. In alternative embodiments, the collar 100 may be configured as one of any number of various shapes, such as a longitudinally-extended, generally square-shaped cross-section, a longitudinally-extended, generally rectangular-shaped cross-section, and/or the like. In the illustrated embodiments herein, the collar 100 is shown to be formed as a longitudinally-extended, generally cylindrically-shaped cross-section.

In current exemplary embodiments of the present disclosure, the collar 100 includes a perimeter wall or outer wall 102 (ex.—a cylindrically-shaped outer wall 102). In further embodiments of the present disclosure, the collar 100 includes a first end wall 104 (ex.—a top end wall 104) and a second end wall 106 (ex—a bottom end wall 106). In still further embodiments of the present disclosure, the top end wall 104 and bottom end wall 106 form opposite ends of the collar 100. In further embodiments of the present disclosure, the top end wall 104 and bottom end wall 106 are each connected to the outer wall 102. In still further embodiments of the present disclosure, the collar 100 includes or forms one or more sloped portions 108 (ex—chamfers 108, chamfered portions 108), said sloped portions 108 being formed on the top end wall 104 at a junction for the top end wall 104 and the outer wall 102.

In exemplary embodiments of the present disclosure, the collar 100 may define a longitudinally-extended cavity 110 which extends from the top end wall 104 to the bottom end wall 106 of the collar 100 and is formed through the top end wall 104 and bottom end wall 106 of the collar 100. For example, the cavity 110 may be a longitudinally-extended square-shaped cavity 110, as shown in FIGS. 1A and 1B. In alternative embodiments, the cavity 110 may be configured as one of any number of various shapes, such as a longitudinally-extended rectangular-shaped cavity, a longitudinally-extended circular-shaped cavity, or the like. In the embodiments illustrated herein, the cavity 110 is shown to be formed as a longitudinally-extended square-shaped cavity. In further embodiments of the present disclosure, the bottom end wall 106 of the collar 100 forms one or more recessed portion(s) 112 or recesses 112. In still further embodiments of the present disclosure, the perimeter wall 102 (ex.—outer wall 102) of the collar 100 may include, may form and/or may have formed therein one or more reveals 114 (ex—grooves 114). For instance, the reveals 114 may extend in a vertical (ex.—longitudinal) direction along the perimeter wall, as shown in FIGS. 1A and 1B and may promote ease of on-site repair of said collar 100.

Figure 2:
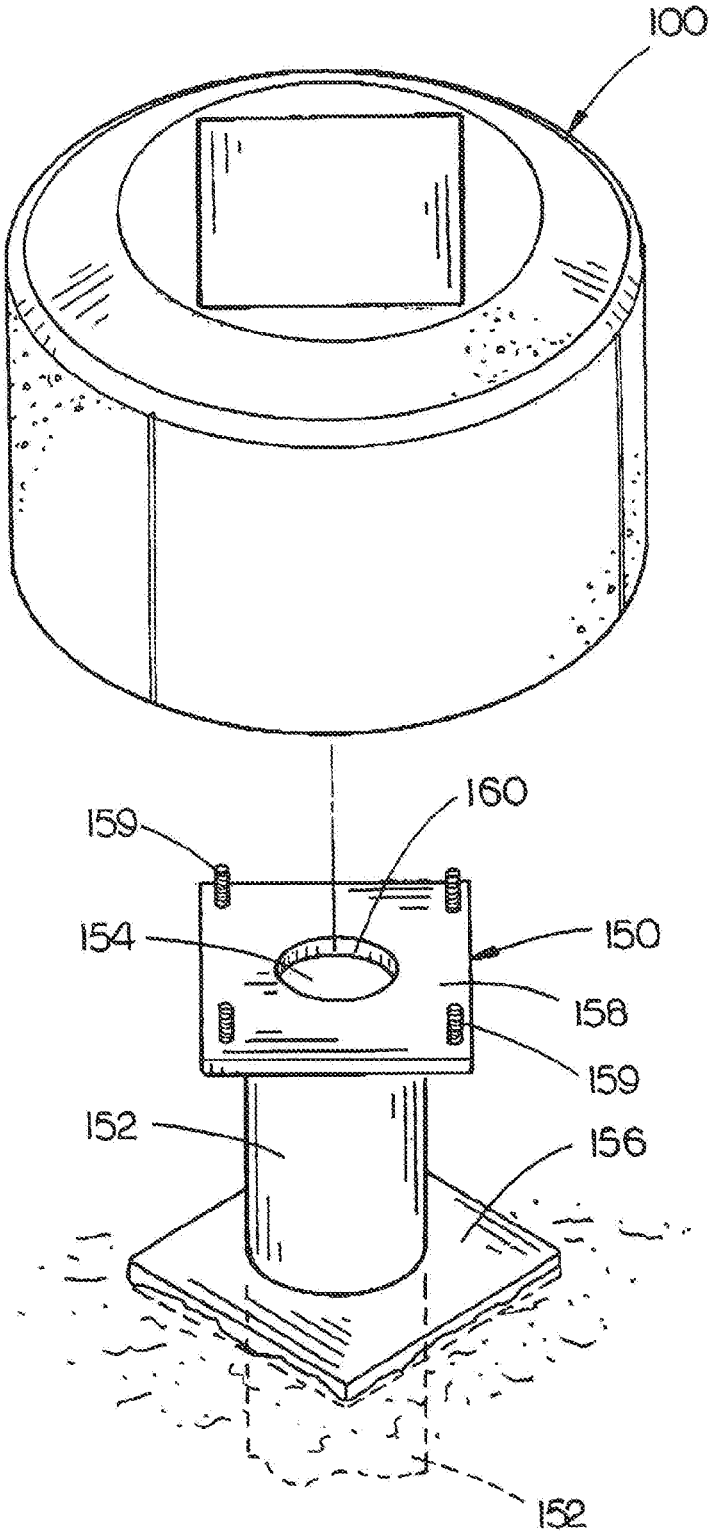
FIG. 2 is a view of a precast surround collar being implemented with a pole foundation in accordance with a further exemplary embodiment of the present disclosure.

In current exemplary embodiments of the present disclosure, as shown in FIG. 2, the collar 100 may be configured for being used as a support structure and/or a protective structure (ex.—a surround structure) for a pole foundation 150. For example, the pole foundation may 150 may be a utility pole foundation 150, such as a helical, power-driven steel pole foundation. In alternative embodiments, the pole foundation may be a foundation for other types (non-utility) poles. In the illustrated embodiments herein, the pole foundation 150 is shown as being a utility pole foundation. In further embodiments of the present disclosure, the pole foundation 150 may include a body structure 152, such as an elongated, cylindrically-shaped body structure. For example, if the pole foundation is 150 is a utility pole foundation, the body structure 152 may include or may form a hollow cavity 154 so as to allow for passage of electrical wiring within the body structure 152.

Figure 3:
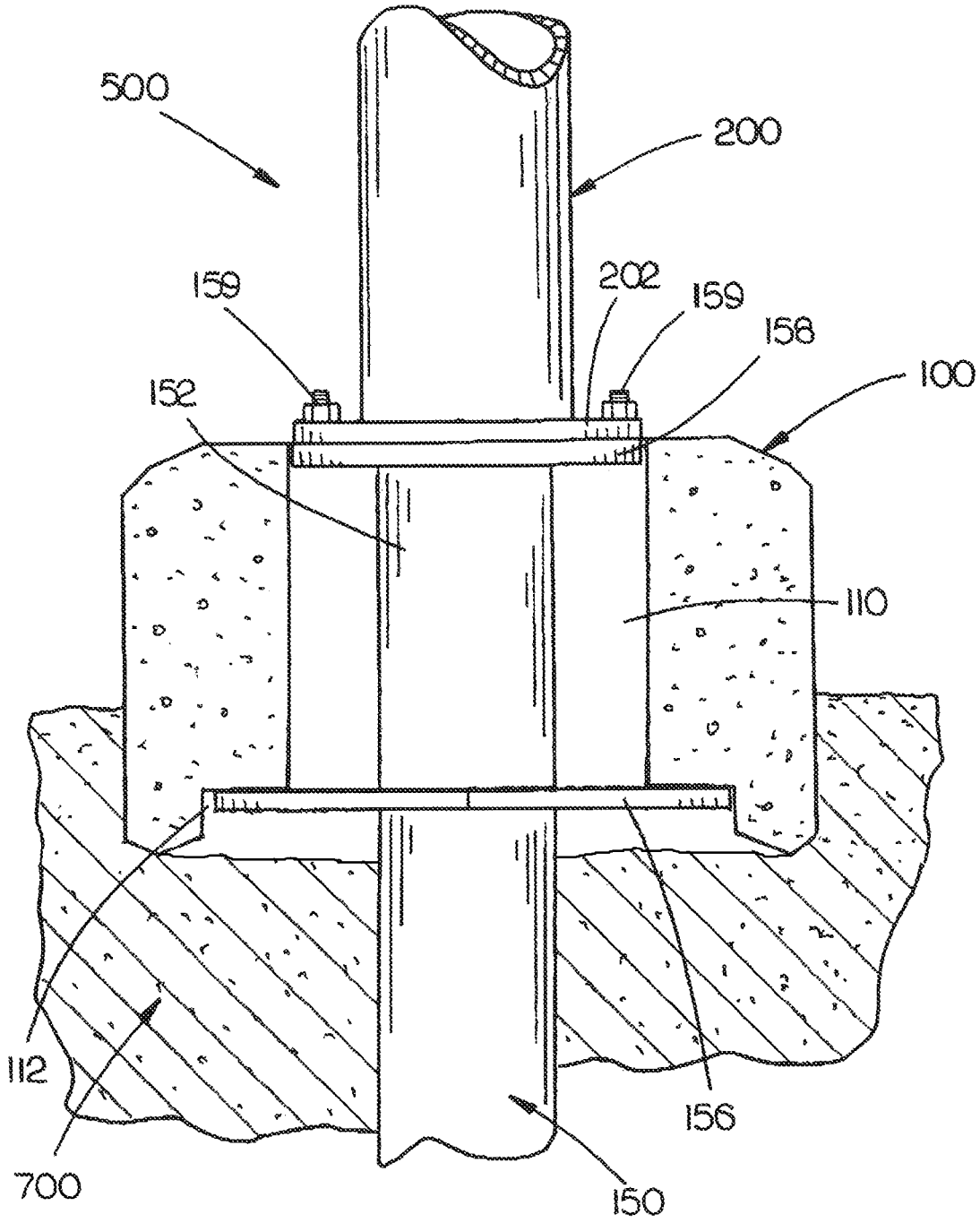
FIG. 3 is a view of an at-grade pole support assembly connected to a pole assembly, including a cross-sectional view of a precast surround collar of the at-grade pole support assembly in accordance with a further exemplary embodiment of the present disclosure.

In exemplary embodiments of the present disclosure, the pole foundation 150 may include a support structure 156, said support structure 156 being connected to the body structure 152. In at least one example, the support structure 156 may be configured so that it is unitary with the body structure 152 of the pole foundation 150. In other examples, the support structure 156 may be configured so that it may be readily connected to and removed from the body structure by a user. In further embodiments of the present disclosure, the pole foundation 150 may include a base structure 158, said base structure 158 being connected to the body structure 152 of the pole foundation 150, said base structure 158 being spaced a non-zero distance apart from the support structure 156 along the body structure 152. In still further embodiments of the present disclosure, the base structure 158 of the pole foundation 150 may be configured for supporting, seating and/or being securably connected with a corresponding base structure 202 (ex.—base plate 202) of a pole 200, as shown in FIG. 3. For example, the base structure 202 of the pole 200 and/or the base structure 158 of the pole foundation may be configured so that the base structures (158, 202) may be fastened together (ex.—via hardware 159, such as bolts, washers, nuts, etc.) for securing the connection of the pole to the pole foundation.

In further embodiments of the present disclosure, the base structure 158 of the pole foundation 150 may include and/or may have an aperture 160 formed therethrough. For instance, in embodiments where the pole foundation 150 is a utility pole foundation 150, said base structure 158 may include said aperture 160 for allowing access (via the aperture 160) to electrical wiring which has been fed through the cavity 154 of the pole foundation 150, so that said electrical wiring may be fed into (ex.—connected to) the pole 200.

As mentioned above, the collar 100 may be configured for being used as a protective structure (ex.—a surround structure), a proprietary support structure and an appearance-enhancing (ex.—non-distracting) base accessory for the pole foundation 150 and the pole 200. In further embodiments of the present disclosure, the collar 100 may be configured for being placed onto the pole foundation 150, such that said collar 100 may be supported upon the pole foundation 150 via the support structure 156 of the pole foundation 150. The pole foundation 150 (ex.—a power-drive pole foundation) may be secured in (ex.—at least partially driven into the ground, parking surface, pavement, etc.), as shown in FIG. 2. For example, the pole foundation 150 may be driven into the ground to a depth sufficient so as to provide the required support strength for the light pole 200 and/or to support pole wind loads. Then, the collar 100 may be placed onto the pole foundation 150 such that, as the collar 100 is being placed onto the pole foundation 150, the bottom end wall 106 of the collar 100 may be aligned with and directed towards the pole foundation 150 so that the base structure 158 and a portion of the body structure 152 of the pole foundation 150 may be received via the bottom end wall 106 into the longitudinally-extended cavity 110. In exemplary embodiments of the present disclosure, the longitudinally-extended cavity 110 may be sized and shaped to allow for entry of the body structure 152 and the base structure 158 of the pole foundation 150 into the cavity 110 of the collar 100 via the bottom end wall 106 and to further allow sufficient clearance for the body structure 152 and base structure 158 to be directed within and/or to pass within and/or to pass through the cavity 110.

In current exemplary embodiments of the present disclosure, when the collar 100 is aligned so that the body structure 152 and the base structure 158 of the pole foundation 150 are successfully able to be directed into, along, and/or through the cavity 110 collar 100 as described above, the bottom end wall 106 of the collar 100 may be further directed towards support structure 156 such that the bottom end wall 106 of the collar 100 engages against and/or is directed against the support structure 156. In exemplary embodiments of the present disclosure, the collar 100 and the pole foundation 150 may be correspondingly configured so that, when the collar 100 is aligned in an orientation which allows the passage of the body structure 152 and base structure 158 of the pole foundation 150 into the cavity 110 of the collar 100, via the bottom end wall 106 of the collar 100, the bottom end wall 106 of the collar 100 may be engaged by the support structure 156 of the pole foundation 150, such that said collar 100 is supported upon the support structure 156. For example, the collar 100 may be configured such that, when utilized with a pole foundation 150 where the support structure 156 and the base structure 158 are in different alignments relative to each other, are different sizes, and/or are different shapes, the bottom end wall 106 of the collar 100 may be engaged by the support structure 156 after the body structure 152 and base structure 158 of the pole foundation 150 have been directed into the cavity 110 of the collar 100, via the bottom end wall 106.

Figure 4:
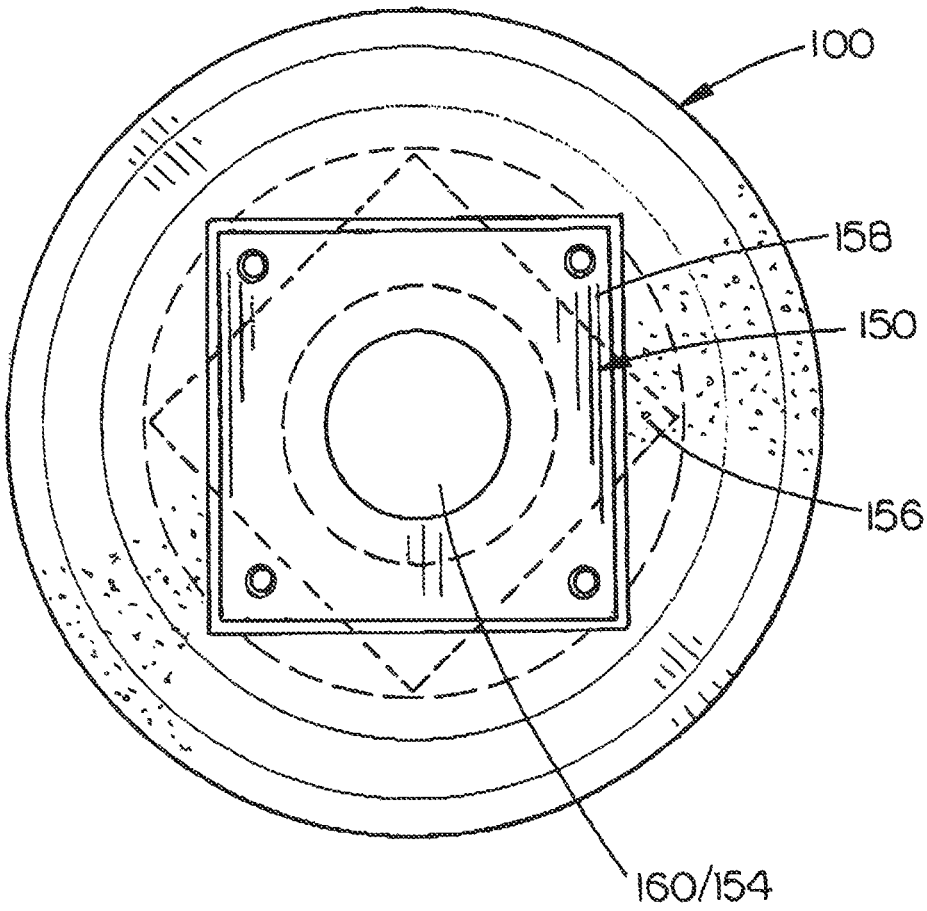
FIG. 4 is a top plan view of a precast surround collar being implemented with a pole foundation in accordance with a further exemplary embodiment of the present disclosure.

FIG. 4 illustrates the collar 100 being used with a pole foundation 150 in which the base structure 158 and the support structure 156 are each similarly sized (ex.—same-same sized) square base plates. However, the base structure 156 is in a first orientation and is aligned with the cavity 110 of the collar 100), while the support structure 156 is in a second, different orientation and is misaligned with cavity (ex.—is turned relative to the base structure 158). As mentioned above, the bottom end wall 106 of the collar 100 may have a recessed portion 112. The collar 100 is configured for engaging the support structure 156, such as when the support structure 156 is aligned as shown in FIG. 4, via the recessed portion 112 of the bottom end wall 106. For example, the recessed portion 112 may be shaped and sized for at least partially receiving the support structure 156, such that portions of the support structure 156 engage against the recessed portion 112 of the bottom end wall 106 once the base structure 158 has been directed into and received by the cavity 110 of the collar 100. Thus, when the support structure 156 and the base structure 158 are in a staggered alignment relative to each other, as shown in FIG. 4, so that the support structure 156 will be misaligned with (ex.—will be able to be positioned within and directed through) the cavity 110 of the collar 100 when the base structure 158 is aligned with (ex.—will not be able to be positioned within and directed through) the cavity 110.

Figure 5:
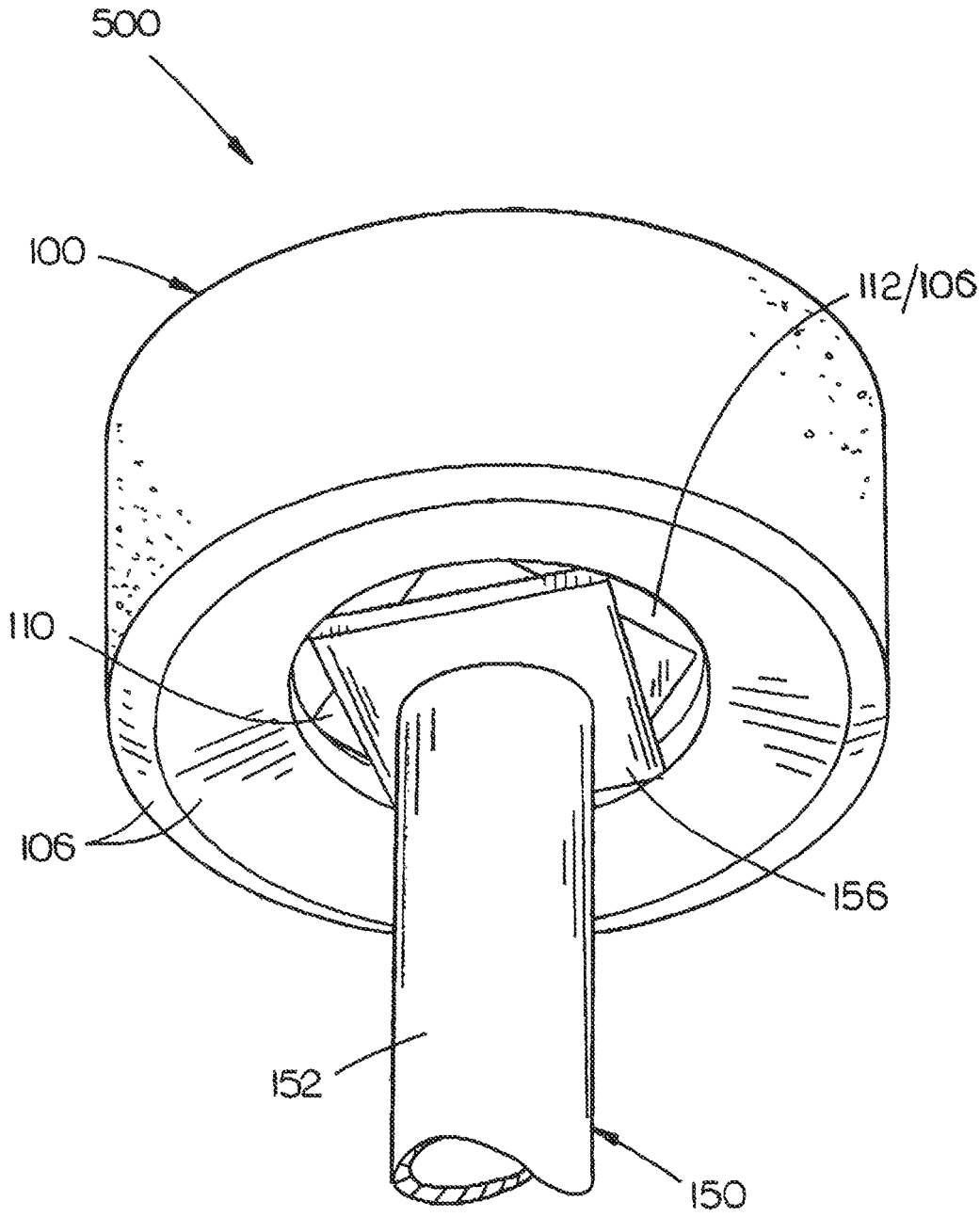
FIG. 5 is a view depicting a support structure of a pole foundation and further depicting the positioning of said support structure within a recess of a precast support collar and the engagement of said support structure against a bottom end wall of the precast support collar in accordance with a further exemplary embodiment of the present disclosure.

FIG. 5 shows the positioning of the support structure 156 of FIG. 4 within the recessed area 112 and against the bottom end wall 106 of the collar 100, portions (ex.—corners) of said support structure 156 engaged against said bottom end wall 106, said configuration of the collar 100 thereby allowing said collar 100 to be supported upon the support structure 156, while also allowing said base structure 158 to be positioned within and directed through the cavity 110. In alternative embodiments of the present disclosure, the bottom end wall 106 of the collar 100 may form one or more recesses 112 (ex.—two recesses) configured for receiving and engaging against the support structure 156 when the support structure 156 is a different size or shape than the base structure. For example, as the collar 100 is directed onto the pole foundation 150, the base structure 158 may be sized and shaped for entry into passage within and/or passage through the cavity 110 of the collar 100, while the support structure 156 may be sized and/or shaped such that it is to large and/or too mis-shaped to be able to be directed into the cavity 110. Further, the collar 100 may be configured such that its recesses 112 provide a support area for the differently-sized and/or differently-shaped support structure 156. For instance, in one embodiment, the base structure 158 and the cavity 110 may have corresponding square shapes, which allow the base structure 158 to be directed into the cavity 110. However, the support structure 156 may be rectangular. Thus, the collar 100, in such embodiments, may be configured with recesses 112 on multiple (ex.—opposing) portions of the bottom end wall 106 which may receive multiple portions of the differently-shaped support structure 156 (ex.—the ends of the rectangular support structure 156) and may allow the collar 100 to be supported on the support structure 156 via said recesses 112 of the bottom end wall.

In exemplary embodiments of the present disclosure, the collar 100 may be configured to be a sufficient height (ex.—distance from the top end wall 104 of the collar 100 to the bottom end wall 106 of the collar 100), that when the bottom end wall 106 of the collar 100 is engaged against the support structure 156, the base structure 158 may be oriented (ex.—located) proximal to the top end wall 104 of the collar 100. For example, when the collar 100 is supported upon the support structure 156, the base structure 158 may be located within the cavity 110, at a level just below or even with the top end wall 104 (as shown in FIG. 3), or may extend just beyond the cavity 110 proximal to the top end wall 104, such that said base structure 158 is accessible for being connected to a the base structure 202 of the pole 200 (as shown in FIG. 3). In one or more embodiments, the collar 100 may be twelve inches in height and may measure twenty-four inches in diameter (ex.—outer diameter, diameter at the outer wall 102). Other exemplary diameters may include but are not limited to diameters ranging from 18 to 28 inches. In further embodiments of the present disclosure, when the collar 100 is positioned against the support structure 156, and the base structure 158 of the pole foundation 150 is positioned so that it is accessible for being connected to the base structure of the pole 200 (as described above, and as shown in FIG. 3), the collar 100 may be configured of sufficient size and shape that it may substantially surround and/or substantially enclose the base structure 158, the support structure 156, and/or a portion of the body structure 152 for promoting protection of the light pole foundation 150.

In further embodiments of the present disclosure, the support structure 156 and the base structure 158 may be any one of a number of various shapes (ex.—square, round, etc.), sizes, or the like. For example, the base structure 158 may be a square base plate which may be 10-15 inches square. In still further embodiments, the support structure 156 may be configured for having the same or different shape, or dimensions as the base structure 158. For example, the support structure 156 may be configured as square base plate which is 12 inches×12 inches.

In an exemplary embodiment, the collar 100 may be implemented as part of an at-grade pole support assembly 500, which includes the collar 100 and the pole foundation 150, said collar 100 being supported upon the support structure 156 of the pole foundation 150, said pole support assembly 500 configured for connecting to and supporting a pole 200 (ex.—utility pole 200), said pole foundation 150 configured for being secured within (ex.—driven into) the ground 700. As shown in FIG. 3, the at-grade pole support assembly 500, when in use, may involve the collar 100 being at least partially buried under the surface of the ground 700 for providing a low-profile collar 100. Further, the pole foundation 150 may be at least partially buried within the ground such that a void (ex.—about a 3 inch gap/void) is established between the support plate 156 and the dirt of the ground 700 (as shown in FIG. 3), thereby reducing the amount of surface area of the collar 100 which is in contact with the dirt/ground 700 and promoting reduction and/or elimination of frost heave concerns. In further embodiments, a pole base cover (not shown) of the pole 200 may be integral with/connected to the pole 200 and may be configured for covering the base structure 158 of the pole foundation 150. In still further embodiments, the cavity 110 defined by the collar 100 may be sized to allow for some degree (ex.—⅜ inch) of horizontal movement of the pole foundation 150 within the assembly 500, thereby allowing for a gap (ex.—a precast gap) between the pole foundation 150 and the collar 100. In further embodiments, the pole base cover (not shown) may be configured for covering said precast gap. In still further embodiments, the precast gap may be filled with caulking if desired/necessary.

Figure 6:
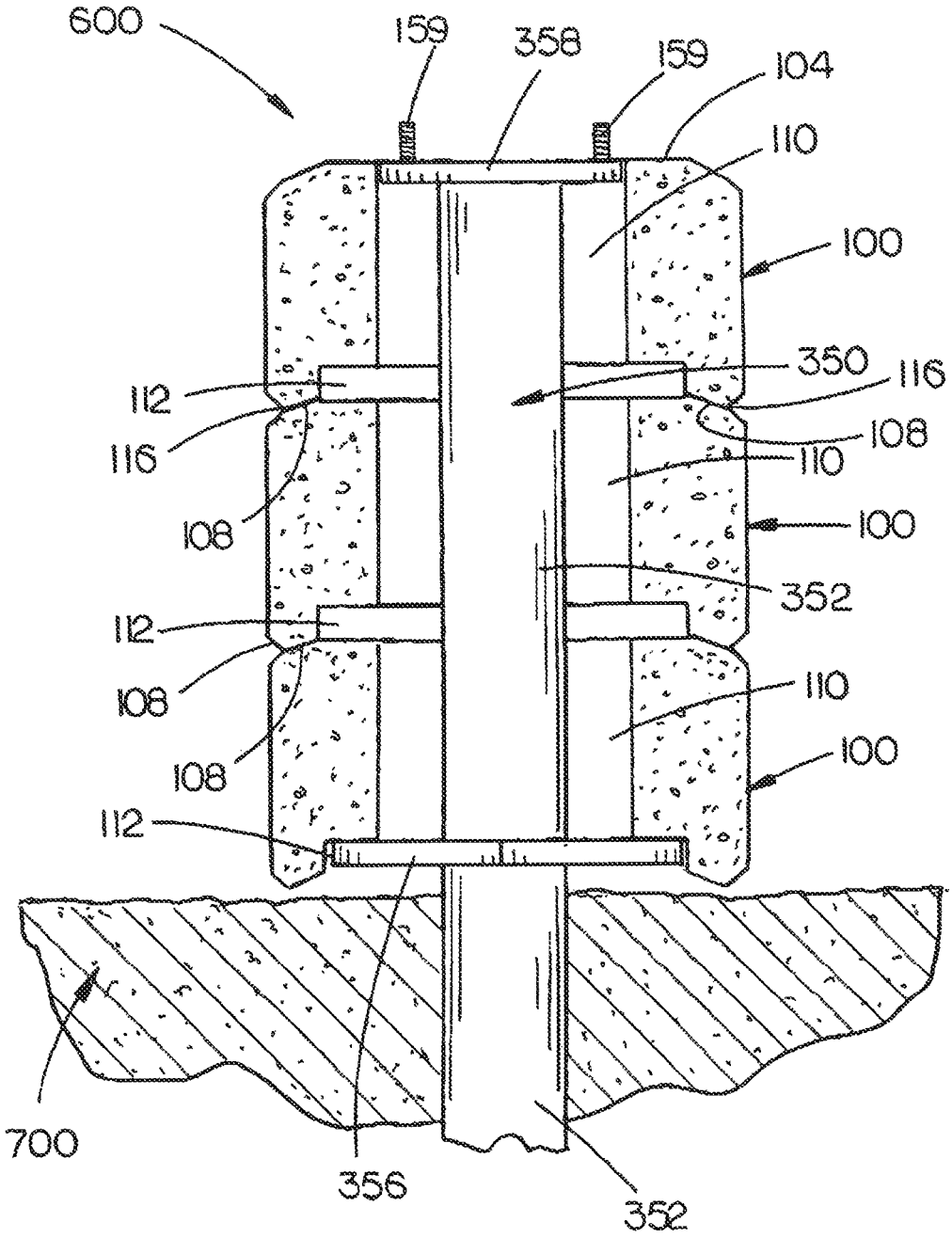
FIG. 6 is a view of a bumper pole support assembly, including a cross-sectional view of a stack formed by a plurality of precast surround collars of the bumper pole support assembly in accordance with a further exemplary embodiment of the present disclosure.
Figure 7:
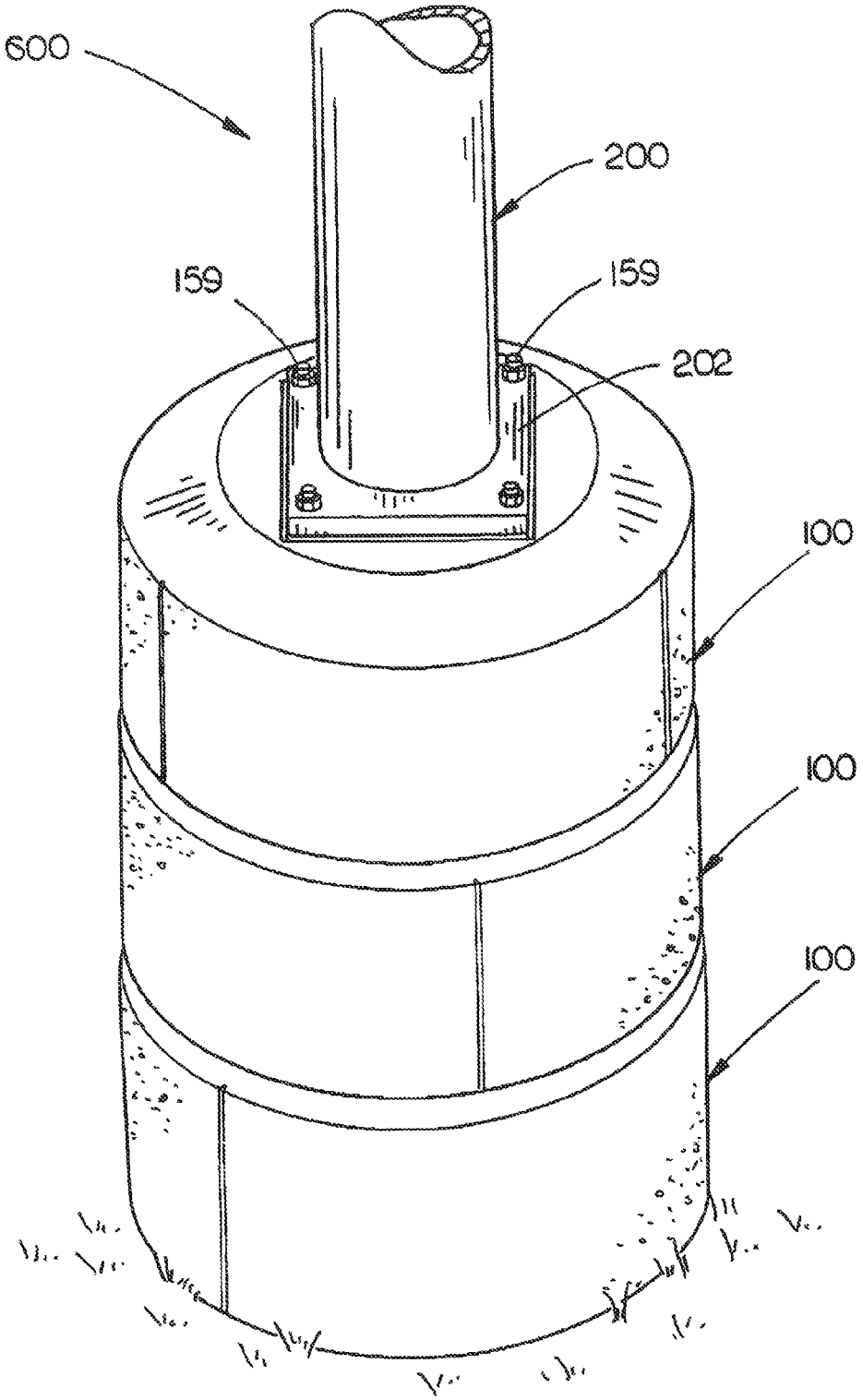
FIG. 7 is a view of bumper pole support assembly being connected to a light pole in accordance with a further exemplary embodiment of the present disclosure.

In further embodiments of the present invention, the collar 100 may be configured for being implemented as part of a multi-piece, bumper pole support assembly 600, as shown in FIGS. 6 and 7. In exemplary embodiments of the present invention, the bumper pole support assembly 600 may include a plurality of collars 100 stacked upon each other and supported upon the support structure 356 of a pole foundation 350, said bumper pole support assembly 600 configured for being connected to a pole 200 (ex.—such as an 8 inch diameter pole which is 40-70 feet high), said pole foundation 350 configured for being secured within (ex.—driven into) the ground. The pole foundation 350 shown in FIG. 6 may include one or more characteristics of the pole foundation 150 described above, except that the support structure 356 and the base structure 358 are configured a sufficient distance apart from each other on the body 352 of the pole foundation 350 that a bottom collar 100 of multiple (ex.—three) may be supported upon the pole foundation 350. For instance, as shown in FIG. 6, the bottom collar 100 of the three collars 100 may be supported upon the support structure 356, the middle collar 100 of the three collars 100 may be stacked upon the bottom collar, while the top collar 100 of the three collars 100 may be stacked upon the middle collar, with said base structure 358 being oriented within or extending just beyond (ex.—1-3 inches beyond) the cavity 110 of the top collar 100, proximal to (ex.—just above, at, or just below) a top end wall 104 of the top collar 100. As discussed above, each collar 100 defines a cavity 110, such that when the collars 100 are stacked to form the assembly 600, the collars 100 are aligned (ex.—the cavities 110 of the collars 100 are aligned) to define an aggregate cavity extending longitudinally through a top end of the assembly 600 and a bottom end of the assembly 600 for accommodating the pole foundation 150. The cavity defined by the stacked collars 100 (ex.—the aggregate cavity) may be sized to allow for some degree (ex.—⅜ inch) of horizontal movement of the pole foundation 350 within the aggregate cavity defined by the stacked collars 100 of the assembly 600.

In further embodiments of the present disclosure, portions of the top end wall 104 and/or the bottom end wall 106 of each collar 100 may form sloped portions 108 (ex.—chamfers 108, chamfered portions 108) for promoting stackability of collars 100 and for promoting secure, stable connection between the collars 100, which may thereby eliminate the need for field grouting/caulking between the collars. When the collars 100 are stacked upon each other as shown in FIG. 6 (ex.—bottom end wall 106 of upper collar 100 is seated upon top end wall 104 of lower collar 100), V-shaped reveals 116 (ex.—key joints 116) may be formed by the chamfers 108 of the collars 100 along, in, and/or on the outer wall 102 at the junction points where the collars 100 connect. The multi-collar, bumper pole support assembly 600, when in use, may involve each of the collars being supported at or just above the level of the ground 700. For example, the bottom-most collar 100 of the multi-collar stack may be supported three inches above grade 700 (ex.—above a parking surface, ground, and/or pavement) for promoting escape of water from the assembly 600 and for alleviating or preventing frost heave concerns.

In current exemplary embodiments of the present disclosure, each collar 100 may be a precast assembly 100 formed of precast concrete for promoting the ability of the collar(s) 100 to protect and support the light pole foundation 150. In further exemplary embodiments, each collar 100 may weigh between 200-375 pounds, for promoting the ability of the collar 100 to provide sufficient support and protection of the light pole foundation 150 (ex.—to allow the collar 100 to withstand reasonable impact from vehicles in a parking area without allowing for damage to the structural integrity of the pole foundation 150). In alternative embodiments, the collar (s) 100, rather than being formed of precast concrete, may be formed of one or more other materials, such as plastic, steel, aluminum, green materials, and/or the like. In further embodiments, the collar(s) 100 of the assembly 600 may be of same or differing dimensions, weight, etc.

In exemplary embodiments, the V-shaped reveals 116 formed by the stacked collars 100 and/or the vertical reveals formed on the outer wall(s) 102 of the collar(s) 100 may promote ease of repair of the assembly 600, such as if the assembly 600 were hit by a vehicle. In such instances, the assembly 600 may be configured such that minor damage may be repaired without requiring replacement of the pole foundation 150 and/or wiring (which may otherwise require disconnection/re-connection of light pole 200 to the light pole foundation 150).

Because the assembly 600 is formed of stackable pieces/components (ex.—collars 100), it may promote ease of storing, shipping, and installation, rather than if one, large one-piece assembly were provided. In further embodiments, the assembly 600 may be implemented with a pole foundation 350 having a base structure 358 (ex.—base plate 358) which is a common base plate for accommodating multiple pole bolt circles of a base structure 202 of a light pole 200.

In further embodiments of the present disclosure, the collars 100 may be configured to provide an aesthetically pleasing surround and support structure for the pole foundation. For example, the collars 100 may be configured in various shapes, may be acid itched/acid etched, may be sandblasted, and may have concrete finishes which are different colors (ex.—dyed charcoal). Further, the collars 100 may provide a protective structure for the pole foundation 150 and a pole base cover of an expensive decorative pole 200 from damage, such as vehicle and/or mower damage. Still further, the collars 100 of the present invention may promote prevention of exposure of the pole foundation 150 due to soil erosion.

Figure 8A:
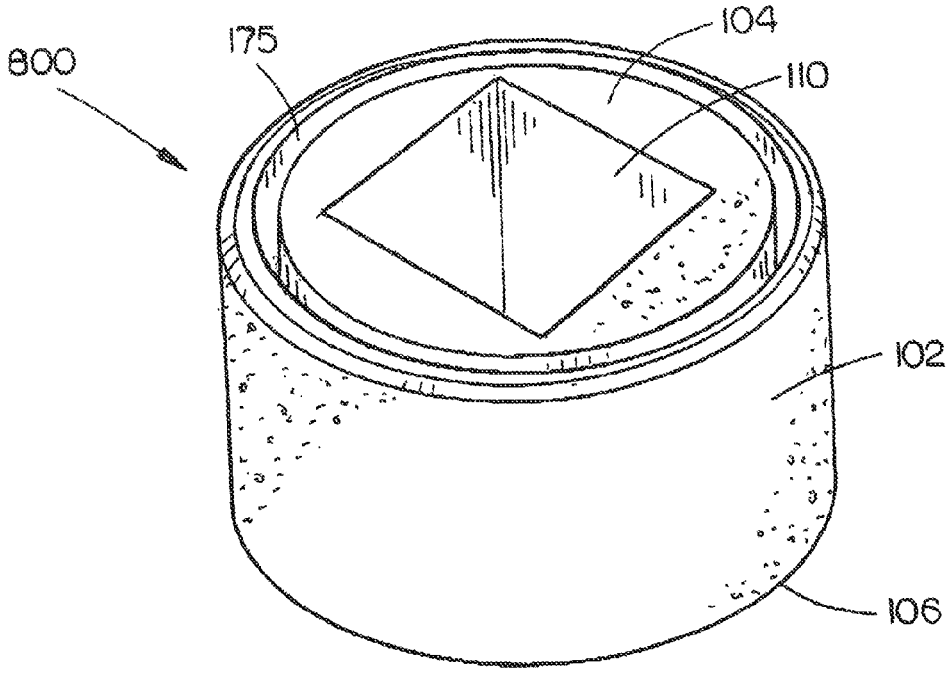
FIG. 8A is an isometric view of a precast support collar having a female keying mechanism in accordance with a further exemplary embodiment of the present disclosure.
Figure 8B:
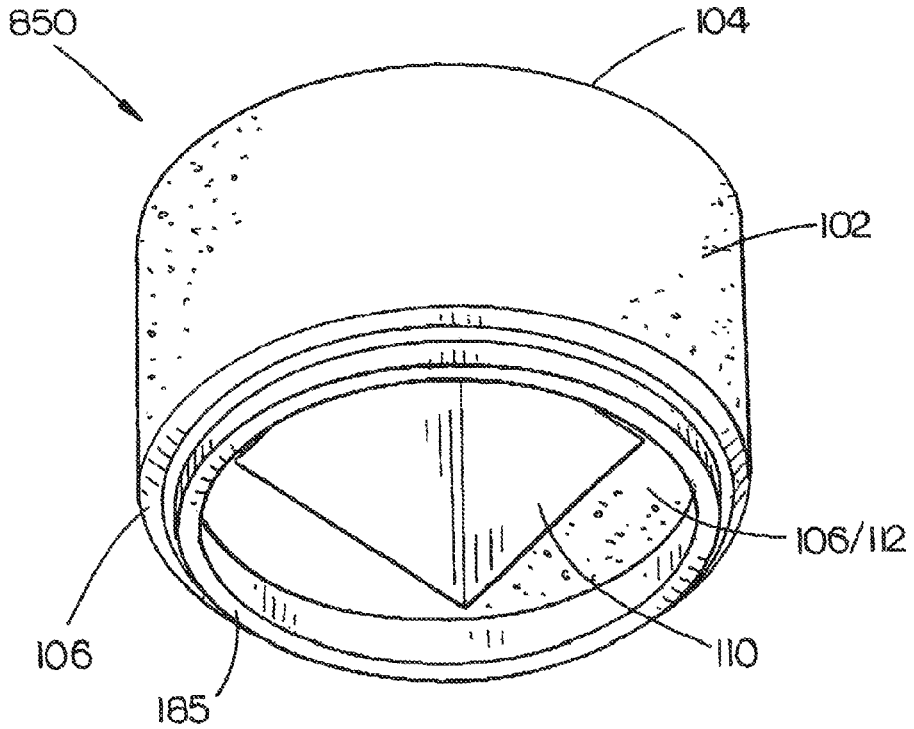
FIG. 8B is an isometric view of a precast support collar having a male keying mechanism in accordance with a further exemplary embodiment of the present disclosure.

Referring to FIGS. 8A and 8B, collars (800, 850) in accordance with further exemplary embodiments of the present disclosure are shown. The collars (800, 850) may be configured for being stacked upon each other to form multi-collar assemblies. The collars 800, 850 may each include one or more characteristics of the collars 100 described above, however, the collars 800, 850 shown in FIGS. 8A and 8B respectively may include keying mechanisms for promoting secure connection of the collars 800, 850 to each other when said collars 800, 850 are stacked upon each other. For the collar 800 depicted in FIG. 8A, a portion of the top end wall 104 of the collar 800 includes or forms a female keying mechanism 175. For example, the top end wall 104 of the collar 800 may have a groove 175 formed therein for providing the female keying mechanism 175. Further, the collar 850 depicted in FIG. 8B, includes a male keying mechanism 185, such that the bottom end wall 106 of the collar 850 includes or forms a male keying mechanism 185. For example, the bottom end wall 106 of the collar 850 may form a ring-shaped protrusion or ridge 185 configured (ex.—correspondingly sized and shaped) for being received by the female keying mechanism 175. In further embodiments of the present invention, the collar 850 having the male keying mechanism 185 may be seated upon the collar 800 having the female keying mechanism 175, such that the collars (800, 850) may be securely stacked upon one another and connected in a stable manner via the keying mechanisms 175, 185, which may thereby eliminate the need for field grouting/caulking between the collars. In alternative embodiments, the collars may be configured with other securing mechanisms and/or structures (ex.—keys, protrusions, locking elements, slots, apertures) for promoting secure connection of stacked collars.

Figure 9A:
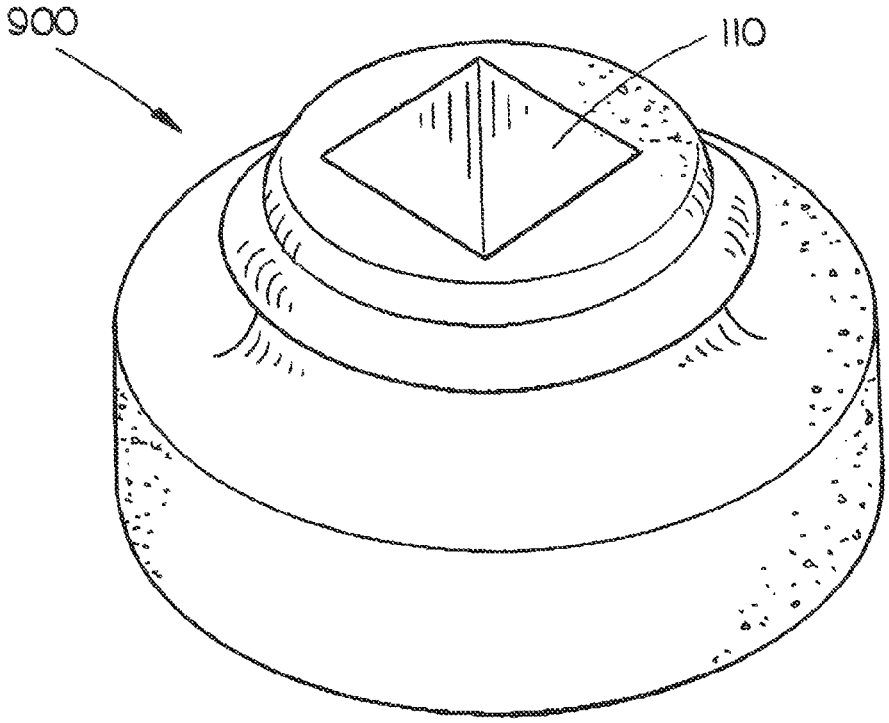
FIG. 9A is an isometric view of a precast support collar having a bull-nose shape in accordance with an alternative exemplary embodiment of the present disclosure.
Figure 9B:
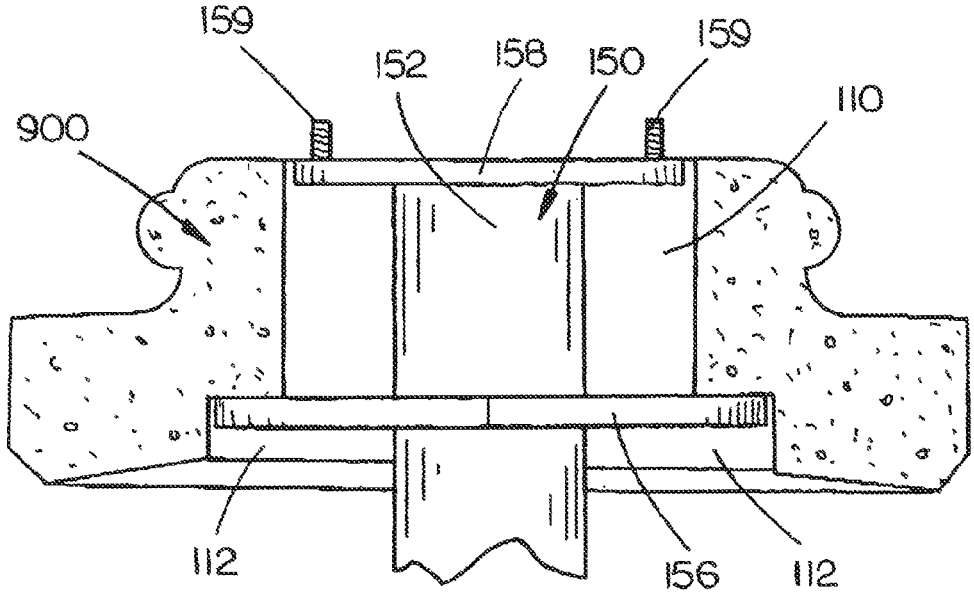
FIG. 9B is a cross-sectional view of the bull-nose shaped collar shown in FIG. 9A being implemented with a pole foundation, in accordance with a further exemplary embodiment of the present disclosure.

FIGS. 9A and 9B show a collar 900 in accordance with a further exemplary embodiment of the present invention. The collar 900 may include one or more of the characteristics of the collar(s) 100 described above, however, the collar 900 shown in FIGS. 9A and 9B may be configured as a bull-nose shape collar 900. In further embodiments, the collar(s) may be configured in any one of a number of various other shapes, such as for enhancing the appearance of the collar(s).

It is believed that the apparatus of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof.

What is claimed is:

1. A collar, comprising:

a perimeter wall;

a first end wall, the first end wall being connected to the perimeter wall; and a second end wall, the second end wall being connected to the perimeter wall, the first end wall and the second end wall forming opposite ends of the collar, said first end wall and said second end wall being spaced apart from each other by the perimeter wall, the second end wall including at least one recessed portion, the at least one recessed portion configured for receiving a support structure of a pole foundation for allowing the collar to be supported upon the support structure via engagement of the support structure against the second end wall, wherein:

the collar forms a longitudinally-extending cavity, said cavity being formed through the collar and extending from the first end wall to the second end wall, said cavity configured for receiving a base structure and a body structure of the pole foundation;

the first end wall and the second end wall of the collar each include chamfered surfaces for connecting each of the first end wall and the second end wall to the perimeter wall; and the perimeter wall includes at least one vertically extending groove for promoting ease of repair and removal of said collar from said pole foundation, said vertically extending groove extending from the first end wall to the second end wall.

2. A collar as claimed in claim 1, wherein the collar is formed of precast concrete.

3. A collar as claimed in claim 1, wherein the collar is configured for at least substantially surrounding the base structure, a portion of the body structure, and the support structure of the pole foundation when: said support structure is received within said recessed portion, the portion of the body structure is located within the cavity, and the second end wall of the collar is seated upon the support structure, for promoting protection of said base structure, said support structure and said portion of the body structure.

4. A collar as claimed in claim 1, wherein the collar is configured such that the base structure of said pole foundation is accessible for being connected to a pole when: said support structure is received within said recessed portion, the portion of the body structure is located within the cavity, and the second end wall of the collar is seated upon the support structure, wherein the first end wall is oriented toward the pole and the second end wall is oriented away from the pole.

5. A precast surround collar for a pole foundation, said precast surround collar comprising:

a perimeter wall;

a first end wall, the first end wall being connected to the perimeter wall; and a second end wall, the second end wall being connected to the perimeter wall, the first end wall and the second end wall forming opposite ends of the collar, said first end wall and said second end wall being spaced apart from each other by the perimeter wall, the second end wall including at least one recessed portion, the at least one recessed portion configured for receiving a support structure of the pole foundation for allowing the collar to be supported upon the support structure via engagement of the support structure against the second end wall, wherein:

the collar forms a longitudinally-extending cavity, said cavity being formed through the collar and extending from the first end wall to the second end wall, said cavity configured for receiving a base structure and a body structure of the pole foundation, the collar being configured for at least substantially surrounding a portion of the body structure, and the support structure of the pole foundation when: said support structure is received within said recessed portion, the portion of the body structure is located within the cavity, and the second end wall of the collar is seated upon the support structure, for promoting protection of said support structure and said portion of the body structure, the collar further being configured such that the base structure of said pole foundation is accessible for being connected to a pole when: said support structure is received within said recessed portion, the portion of the body structure is located within the cavity, and the second end wall of the collar is seated upon the support structure, wherein the first end wall is oriented toward the pole and the second end wall is oriented away from the pole;

the first end wall and the second end wall of the collar each include chamfered surfaces for connecting each of the first end wall and the second end wall to the perimeter wall; and the perimeter wall includes at least one vertically extending groove for promoting ease of repair and removal of said collar from said pole foundation, said vertically extending groove extending from the first end wall to the second end wall.

6. A precast surround collar as claimed in claim 5, wherein the precast surround collar is formed of precast concrete.

* * * * *